US008104379B2

(12) United States Patent
Hanlon

(10) Patent No.: US 8,104,379 B2
(45) Date of Patent: Jan. 31, 2012

(54) GRAPHITE / TITANIUM HAMMER

(75) Inventor: Jared W. Hanlon, Santa Clarita, CA (US)

(73) Assignee: Pull'r Holding Company, LLC, Elk Grove Village, IL (US)

( * ) Notice: Subject to any disclaimer, the term of this patent is extended or adjusted under 35 U.S.C. 154(b) by 0 days.

(21) Appl. No.: 12/727,762

(22) Filed: Mar. 19, 2010

(65) Prior Publication Data

US 2010/0224031 A1 Sep. 9, 2010

Related U.S. Application Data

(63) Continuation of application No. 12/022,988, filed on Jan. 30, 2008, now abandoned.

(60) Provisional application No. 60/887,322, filed on Jan. 30, 2007.

(51) Int. Cl.

| | |
|---|---|
| ***B25D 1/00*** | (2006.01) |
| ***B25D 1/12*** | (2006.01) |
| ***B25D 1/04*** | (2006.01) |
| ***B25G 1/01*** | (2006.01) |

(52) U.S. Cl. ..... 81/20; 81/22; 81/489; 7/143; 7/146

(58) Field of Classification Search ..... 81/20–27, 81/489; 7/143–147, 167

See application file for complete search history.

(56) References Cited

U.S. PATENT DOCUMENTS

| | | | | |
|---|---|---|---|---|
| 3,786 | A * | 10/1844 | Bigelow | 384/296 |
| 5,408,902 | A * | 4/1995 | Burnett | 81/22 |
| 5,911,795 | A * | 6/1999 | Tucker | 81/22 |
| 6,311,369 | B1 * | 11/2001 | Ryu | 16/436 |
| 6,457,384 | B1 * | 10/2002 | Cox et al. | 81/22 |
| 7,404,346 | B2 * | 7/2008 | Youngren et al. | 81/20 |
| 2003/0071019 | A1 * | 4/2003 | Cline et al. | 216/109 |
| 2004/0149086 | A1 * | 8/2004 | Jackson | 81/23 |
| 2006/0048608 | A1 * | 3/2006 | Santa Ana | 81/23 |

FOREIGN PATENT DOCUMENTS

JP 3151926 U * 7/2009

* cited by examiner

*Primary Examiner* — Bryan R Muller

(74) *Attorney, Agent, or Firm* — Cherskov & Flaynik

(57) ABSTRACT

According to disclosure, the hammer has a head made of striking grade steel. The handle comprises a 6-4 titanium hand grip and over strike plate insert in the handle and under the head. The head has an eye for accommodating a handle which in a preferred embodiment is made of a graphite titanium composite comprising from about 60 to 65% graphite by weight and from about 35 to 45% 6-4 titanium. The head of hammer has a claw end and a striking head. Also disclosed is a method of manufacturing the device of the disclosure comprising using one or more bladder compressed carbon fiber processes to anneal the graphite, titanium and steel components of the hammer.

10 Claims, 3 Drawing Sheets

GRAPHITE / TITANIUM HAMMER

CROSS REFERENCE TO RELATED APPLICATIONS

This application claims the benefit of U.S. Utility application Ser. No. 12/022,988 filed on Jan. 30, 2008, currently pending; which in turn claimed priority to U.S. Provisional Application 60/887,322 filed Jan. 30, 2007.

BACKGROUND OF THE INVENTION

1. Field of the Invention

The present invention is in the area of hand-held striking tools, such as hammers, and pertains more specifically to lightweight hammers.

2. Background of the Invention

Hand-held striking tools, such as claw hammers, have been used for a variety of tasks for centuries. A hammer is basically a force amplifier that works by converting kinetic energy into mechanical work. Claw hammers typically weigh from 7 to 32 ounces, and are used for driving a target into a substrate, such as a nail into wood. The claw portion of the claw hammer also can be used to remove a target, such as a nail, or for ripping apart a substrate, such as wood or pieces of wood.

This type of hammer works as a third-class lever, with the fulcrum or pivot point being the wrist of the user, and the lever arm being the length of the hammer handle. The head, at a distance of the handle from the fulcrum, moves faster than the user's wrist, and this increased speed factored with the weight of the hammer's head and gravity has typically provided the force for driving the target into a substrate.

In the swing that precedes each hammer blow, a certain amount of kinetic energy gets stored in the hammer's head. When the hammer strikes its target, the head gets stopped by an opposite force coming from the target, for example a nail being driven into a piece of wood, which is equal and opposite to the force applied by the head to the target.

The amount of kinetic energy (KE) delivered to the target by the hammer blow is equivalent to the mass of the head (m) times the square of the head's speed ($v^2$) at the time of impact, or $KE=0.5*m*v^2$. Increasing the speed of the hammer's head when it strikes a target exponentially increases the kinetic energy delivered to the target, thereby increasing the amount of work done with each strike of the hammer.

One way to increase the speed of the hammer's head is to increase the length of the hammer's handle. However, it is typically more difficult to accurately squarely hit a nail with a longer handled than a shorter handled hammer. Using a longer hammer may also be awkward or impossible in close spaces.

Another way to increase the hammer head's speed is to lighten the weight of the hammer itself, thereby increasing the potential speed with which a user can swing the hammer. Such a lighter hammer can then be swung faster through the arc defined by the length of the hammer's handle rotating about the fulcrum, which is typically a user's wrist.

Prior art has introduced light weight materials into the heads and handles of hammers to increase hammer speed. The drawbacks of many such materials include malleability, high cost, brittleness, tempering, vibration transmitted to the hand of the user and overall lack of durability.

The present invention comprises graphite and titanium regions in the handle that provide for flexibility and an increased strength to weight ratio.

When a hammer's handle has an increased strength to weight ratio, the weight of the head can be reduced somewhat, but the invention maintains the "head-weight" that carpenters are used to. While graphite alone is lightweight, it must be protected with titanium strike surfaces below the head of the hammer and also at the "butt" end of the handle, which is sometimes used as a striking surface. It is the object of the invention to provide a lightweight yet durable hammer that allows the user to increase the work performed by each hammer blow due to the lightness of weight of the hammer itself, and more particularly due to the strength to weight ratio of the hammer's handle.

It is a further object of the invention to provide a hammer that does not unpleasantly vibrate in the hand of the user, and that will neither dent nor crack under normal use, including when the user mis-strikes a surface and the blow lands on the handle of the hammer instead of the striking surface of the hammer's head.

It is a still further object of the invention to provide these qualities in a relatively inexpensive hammer.

It is a still further object of the invention to provide a method of assembling or manufacturing said hammer.

DESCRIPTION

According to the invention, the hammer has a head made of striking grade steel. In one embodiment, the head of hammer has a claw end and a striking head. In one embodiment, the handle comprises a 6-4 titanium hand grip and over strike plate insert in the handle and under the head. The head has an eye for accommodating a handle which in an embodiment is made of a graphite titanium composite comprising from about 60 to 65% graphite by weight and from about 35 to 45% titanium.

Also disclosed is a method of manufacturing the device of the disclosure comprising using one or more bladder compressed carbon fiber processes to anneal the graphite, titanium and steel components of the hammer.

In one embodiment, the invention comprises a hammerhead having a first end and a second end wherein said first end comprises a striking surface; a lightweight handle having graphite and titanium regions wherein said lightweight handle has a first end in communication with said hammerhead and a second end; and a titanium overstrike plate extending over the side of said handle and extending over said second end of lightweight handle wherein said titanium overstrike plate is further in communication with said hammerhead.

BRIEF DESCRIPTION OF DRAWING

The invention together with the above and other objects and advantages will be best understood from the following detailed description of the preferred embodiment of the invention shown in the accompanying drawings, wherein.

DETAILED DESCRIPTION OF THE INVENTION

Figures 1, 5:
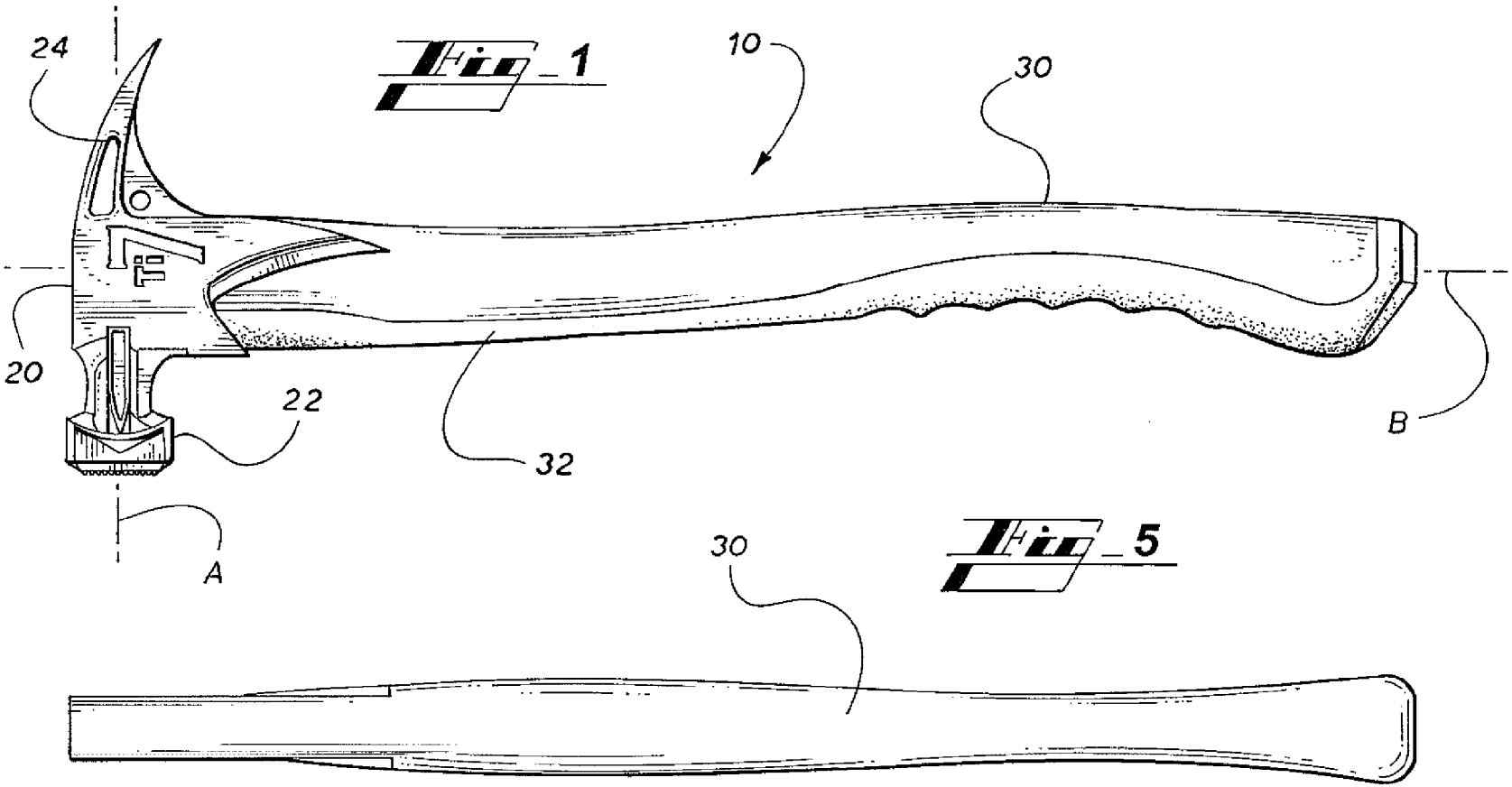
FIG. 1 is a side elevation of one embodiment of a device of the disclosure.
FIG. 5 is a plan view of the upper side of a handle of one embodiment of a device of the disclosure.

As illustrated in FIG. 1, the device of the disclosure 10 comprises a hammer head 20, and a hammer handle 30. The head defines an axis A that runs the width of the head, and the handle defines an axis B that runs the length of the handle. In one embodiment, the axes of head and handle (A,B) comprises about a 90 degree angle.

The head 20 comprises impact grade steel, and the handle 30 comprises a graphite titanium composite. In one embodiment, the handle comprises a graphite titanium and fiberglass composite. In still another embodiment, the handle 30 of the device 10 comprises a graphite titanium fiberglass and foam handle 20.

While many types of titanium can be used in the invention, at least one preferred embodiment comprises 6-4 titanium. Such 6-4 titanium may also be referred to as "grade 5" titanium, comprises a tensile strength of 130,000 psi, and comprises approximately 90 percent titanium, 6 percent aluminum, and 4 percent vanadium. However, other grades and alloys of titanium with slightly different properties may be used.

A titanium overstrike plate 39 runs the length of the handle 30 and wraps around the butt end 36 as the butt end 36 may sometimes be used as a striking surface. The overstrike plate 39 improves strength in the hammer overall by providing at least a single piece of titanium that runs the length of the handle 30 and into the head 20 of the hammer, to which the handle 30 is permanently affixed. Further, the titanium overstrike plate 39 protects the handle's integrity by resisting torque and by providing an overstrike surface to deflect misstrikes of the hammer in which the head surface does not cleanly contact the target of the hammer's head. Still further, the overstrike plate 39 reduces vibrations transmitted from the surface struck by the hammer to the user's hand and arm.

Figure 2:
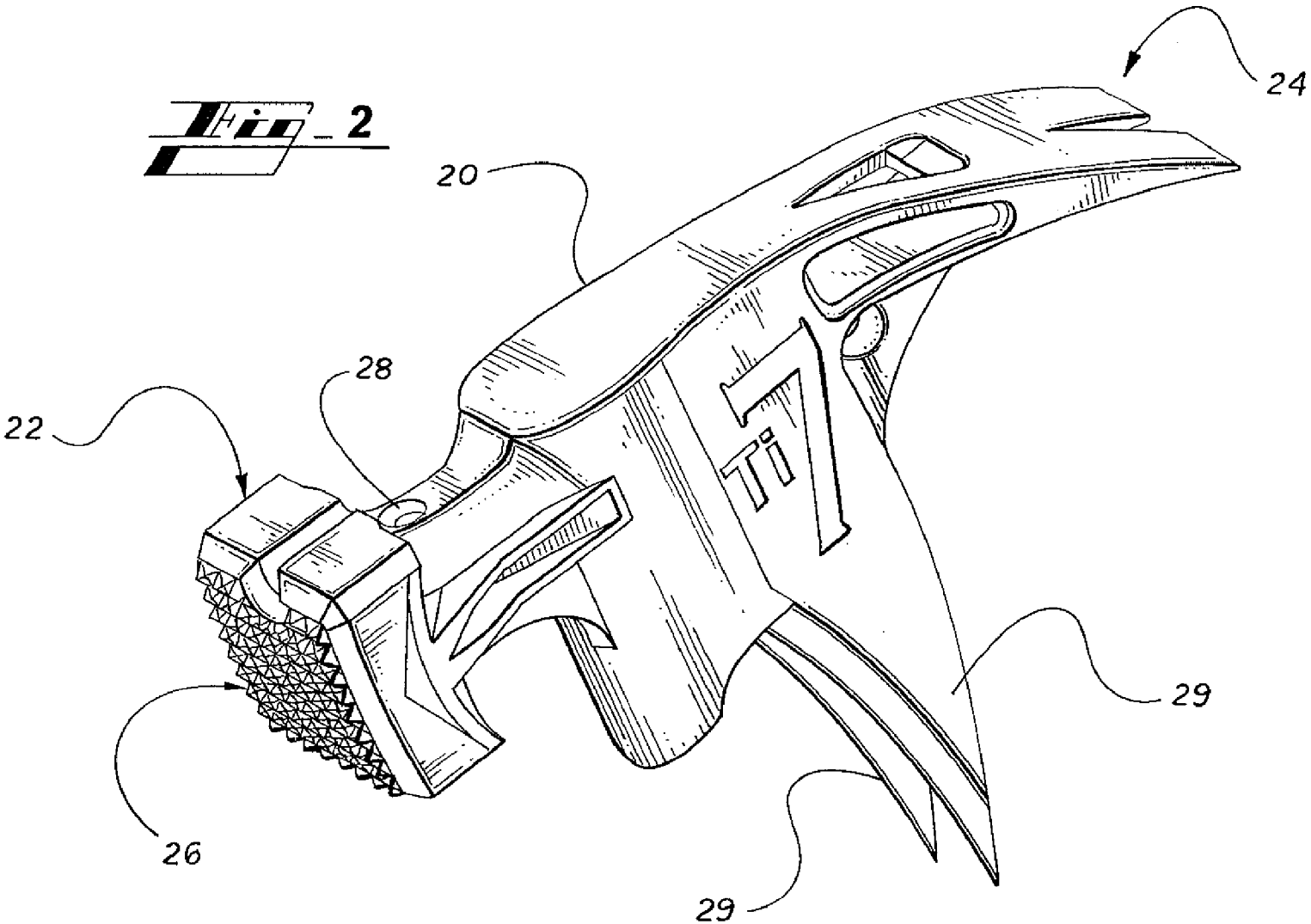
FIG. 2 is a perspective view of a head of one embodiment of a device of the disclosure.

In one embodiment of the disclosed device 10, as illustrated in FIG. 2 the head 20 of the hammer comprises one striking end 22 and one claw end 24. In another embodiment, the striking end comprises a striking surface 26 comprising a multi faceted or pyrimidal shaped surface. In still another embodiment, the striking face pattern comprises a triangle pattern or any other pattern that allows for several more points of contact than traditional striking tools. The head 20 also comprises a nail pull cavity 28 integrated into top portion of the either the striking surface, the claw, or both, which cavity is in one embodiment round or triangularly shaped.

The graphite of the device may be any type of carbon fiber. In a preferred embodiment, the carbon fiber used is standard elastic modulus type fiber (2.4-5.0 GPa tensile strength and 200-280 GPa tensile elastic modulus) or intermediate elastic modulus type fiber (3.5-7.0 GPa tensile strength and 280-350 GPa tensile elastic modulus). However, high elastic modulus fiber (2.4-5.0 GPa tensile strength and 350-600 GPa tensile elastic modulus), while typically more expensive, may also be used to good effect. The carbon fiber is currently available through Toray and Mitsubishi.

The handle 30 of the disclosed device comprises a graphite titanium composition bonded together during a bladder compressed carbon fiber process. After undergoing the bonding method, disclosed below, the graphite bonds with the titanium overstrike plate 39 and the head 20 to form a hollow shell or layer of carbon fiber. In one embodiment, that hollow shell will be filled with foam to create a foam core 38.

In one embodiment, the handle 30 comprises a graphite titanium composite comprising from about 60 to 75% graphite by weight and from about 25 to 35% titanium. In another embodiment, the handle 30 comprises a graphite, fiberglass and titanium composite comprising from about 40 to 55% graphite by weight, about 20-30% fiberglass by weight and from about 25 to 35% titanium by weight. In still another embodiment, the handle comprises a graphite, fiberglass, a medium density cellulose foam and titanium composite comprising from about 35 to 45% graphite by weight, about 25 to 35% fiberglass by weight, about 15 to 25% foam by weight and from about 25 to 35% titanium by weight.

The graphite is bonded to the titanium and other composite components during a bladder compressed molding process. A negative mold is created of the entire device of the disclosure, including the head 20. In one of the preferred embodiments, graphite fibers comprising a graphite cloth are layered onto a prepared mold section according to the direction of the carbon fibers. The number of layers of carbon cloth corresponds to the desired strength needed at that position of the hammer's handle 30.

In one embodiment, carbon fibers embedded in the handle 30 of the disclosed device 10 run perpendicular or parallel to the longitudinal axis of the handle 30 or to the width of the head 20 of the device of the disclosure. In another embodiment, about 50% of the cloth's carbon fibers run parallel to the axis defined by the head A but perpendicularly to the axis defined by the handle B and about 50% run parallel to the axis defined by the handle B but perpendicularly to the axis defined by the head A.

Figure 3:
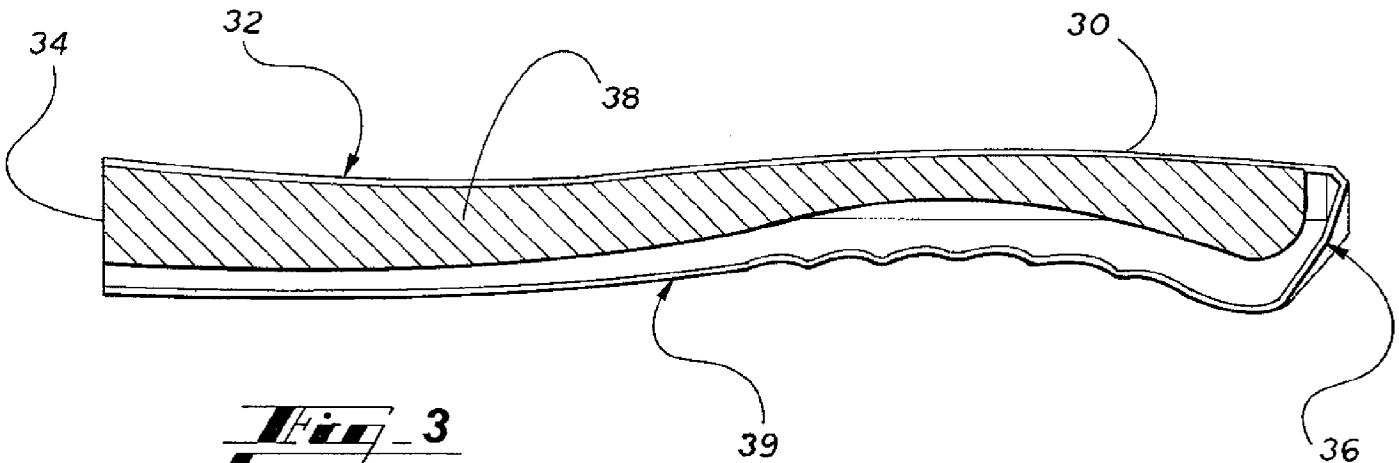
FIG. 3 is a sectional view along live A-A of FIG. 4 of one embodiment of a device of the disclosure.

As illustrated but not to scale in FIG. 3, the thickness of the layer or layers of woven fibers 32 forming the shell of the handle 30 may vary at different positions between the end of the handle inserted into the striking head 34 and the butt end 36 of the handle. In one embodiment, the thickness 32 varies from about 0.035" to about 0.065.

The use of graphite and titanium, with or without the other fiberglass and foam components, provides a lightweight, strong handle that reduces the vibration transmitted from the hammer's head to the hand and arm of a user. Use of fiberglass decreases cost of production. Use of a foam core 38 further strengthens the integrity of the handle, and therefore of the device of the disclosure itself, and also further reduces vibration and impact felt by a user during use of the disclosed device. In one embodiment of the device disclosed, a medium density cellulose foam is used.

Figure 4:
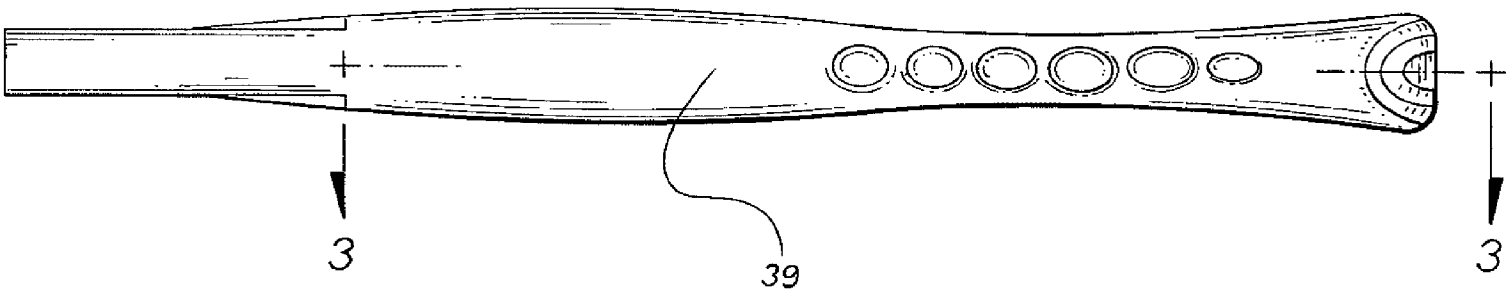
FIG. 4 is a plan view of the underside of one embodiment of a device of the disclosure.

The titanium overstrike plate 39 of the handle, as illustrated in FIGS. 3 and 4, and the hammer's steel head 20 are included in the compression/bladder mold with the arranged carbon fibers, and through processing, all components are molded and bonded together. The processing may be conducted at 250 to 400 degrees Fahrenheit, from about 10-12 psi, and for about 2½ to about 3½ hours during which the elements are processed under heat and pressure.

After molding has been completed, a plastic overlayer is added to the entire device to protect the device 10 from disfiguration.

The compression/bladder mold requires all of the elements of the device 10 including its head 20, typically comprised of impact grade steel, the overstrike plate and hand grip of titanium 39, and the handle 30 to be molded together as a single unit. Additionally, as illustrated in FIG. 2, supports 29 extending from the head 20 strengthen the handle 30 and aid in the elimination of perpendicular moment created by existing striking tool assembly.

Also disclosed is a method of manufacturing the disclosed device. That method comprises constructing a handle 30 comprising a graphite titanium composite and a titanium overstrike plate 39; constructing a striking grade steel head 20; and joining the striking head 20 to the handle 30.

The graphite used in the method may comprise carbon fibers or carbon fibers woven into a cloth. The fibers of the cloth may be arranged perpendicularly.

The graphite is bonded to the titanium used in the method by heating the fibers in a compression-bladder mold with the titanium. The hammer's steel head 20 is also permanently attached to the handle 30 during this molding step.

In another embodiment of the method of the disclosure, the method of manufacturing the disclosed device comprises:

1. creating a negative mold of a hammer 10, which mold comprises a top section and a bottom section;
2. applying petroleum jelly to the insides of the top and bottom sections of the mold;
3. creating an impact grade steel hammer head 20, the head comprising an orifice for receiving and bonding to a hammer handle 30;
4. providing an epoxy bonding material within the orifice, the epoxy adapted to permanently bond the head 20 and handle 30 together;
5. placing the head 20 in the bottom section of the mold;
6. creating a titanium overstrike plate 39 comprising an striking surface and a bonding surface, which striking surface is adapted to cover at least the length of the handle from below the striking surface of the head to an end of the handle opposite the head;
7. providing an epoxy bonding material on the bonding surface of the plate 39, the epoxy adapted to permanently bond the plate with graphite;
8. positioning the overstrike plate 39 within the bottom section of the mold;
9. arranging woven carbon fiber material in the bottom section of the mold to a depth of about 0.035" to about 0.065" thick;
10. arranging woven fiberglass pieces previously dipped in a doping compound on top of the carbon fiber material;
11. placing a high temperature bladder on top of the fiberglass;
12. wrapping the carbon material over the ends and edges of the bladder;
13. repeating steps a through d, inclusive, for the top section of the mold;
14. placing the top and bottom sections of the mold together and securing them together;
15. inflating the bladder to a pressure of about 10 to about 12 psi;
16. placing the mold in an oven heated to about 250 to about 400 degrees Fahrenheit for about 2.5 to 3.5 hours while maintaining the pressure within the bladder;
17. removing the mold from the oven and allowing the bladder to deflate;
18. extracting the molded hammer 10 from the mold;
19. introducing fluid medium density cellulose foam 38 into the cavity created by the removed bladder and permitting the foam to harden; and
20. coating the hammer with a plastic layer adapted to protectively coat the hammer.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting, but are instead are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and " in which" are used as the plain-English equivalents of the terms "comprising" and "wherein." Moreover, in the following claims, the terms "first," "second," and "third," are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

The invention claimed is:

1. A lightweight hammer comprising:

a hammer-head having a first end and a second end wherein said hammer-head first end comprises a striking surface;

a lightweight composite handle comprising graphite wherein said lightweight handle further comprises a foam core, a head end in communication with said hammer-head and a butt end and a striking side wherein said striking side of the handle is a side of the handle which is parallel with the striking surface of the hammer-head, wherein said handle is encapsulated by a layer of woven fibers; and a titanium overstrike plate covers the striking side of said handle along the length of the striking-side of the handle from the hammer-head to the butt end of handle wherein said striking plate covers the butt end of the handle.

2. The lightweight hammer of claim 1 wherein said hammer-head comprises steel.

3. The lightweight hammer of claim 2 wherein said hammer-head further comprises a nail-pulling aperture defined in a top surface of said hammer-head first end wherein said top surface is arranged substantially perpendicular to the striking surface of the hammer head first end.

4. The lightweight hammer of claim 1 wherein a hammer-head axis is defined by the middle of the width of the hammer-head and a handle axis is defined by the middle of the length of the handle wherein a 90 degree angle is formed by an intersection of the hammer-head axis and the handle axis.

5. The lightweight hammer of claim 1 wherein said overstrike plate comprises 6-4 titanium.

6. The lightweight hammer of claim 1 wherein said hammer-head is permanently affixed to said lightweight handle.

7. The lightweight hammer of claim 1 wherein said hammer-head second end comprises a claw structure.

8. The lightweight hammer of claim 3 wherein said nail-pulling aperture is triangular.

9. The lightweight hammer of claim 1 wherein said titanium overstrike plate is bonded to said lightweight handle wherein the thickness of said layer of woven fibers varies at different positions between the head end of the handle and the butt end of the handle.

10. A lightweight hammer consisting of:

a hammer-head having a first end and a second end wherein said hammer-head first end comprises a striking surface and said second end comprises a claw;

a lightweight graphite composite handle wherein said lightweight handle comprises a foam core, a head end in communication with said hammer-head, a butt end and a striking side wherein said striking side of the handle is parallel with the striking surface of the hammer-head, wherein said handle is encapsulated by a layer of woven fibers; and a titanium overstrike plate covers the striking side of said handle along the length of the striking-side of the handle from the hammer-head to the butt end of handle wherein said striking plate covers the butt end of the handle.

* * * * *